US008852304B2

(12) United States Patent
Middlemiss

(10) Patent No.: US 8,852,304 B2
(45) Date of Patent: Oct. 7, 2014

(54) THERMALLY STABLE DIAMOND BONDED MATERIALS AND COMPACTS

(75) Inventor: Stewart N. Middlemiss, Salt Lake City, UT (US)

(73) Assignee: Smith International, Inc., Houston, TX (US)

( * ) Notice: Subject to any disclaimer, the term of this patent is extended or adjusted under 35 U.S.C. 154(b) by 944 days.

(21) Appl. No.: 12/689,389

(22) Filed: Jan. 19, 2010

(65) Prior Publication Data

US 2010/0115855 A1 May 13, 2010

Related U.S. Application Data

(62) Division of application No. 11/122,541, filed on May 4, 2005, now Pat. No. 7,647,993.

(60) Provisional application No. 60/568,893, filed on May 6, 2004.

(51) Int. Cl.

| | |
|---|---|
| ***B24D 11/00*** | (2006.01) |
| ***B24B 1/00*** | (2006.01) |
| ***B24D 3/00*** | (2006.01) |
| ***B24D 18/00*** | (2006.01) |
| ***C09K 3/14*** | (2006.01) |
| ***B22F 7/06*** | (2006.01) |
| ***E21B 10/567*** | (2006.01) |
| *B22F 5/00* | (2006.01) |

(52) U.S. Cl.

CPC ..... *E21B 10/567* (2013.01); *B22F 7/06* (2013.01); *B22F 2005/001* (2013.01); *B22F 2998/00* (2013.01)

USPC ..... 51/295; 51/293

(58) Field of Classification Search

USPC ..... 51/295, 293

See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |

(Continued)

FOREIGN PATENT DOCUMENTS

| | | | |
|---|---|---|---|
| CA | 2506471 | A1 | 11/2005 |
| EP | 0 196 777 | | 10/1986 |

(Continued)

OTHER PUBLICATIONS

Response dated Jan. 7, 2011, to Office Action dated Oct. 7, 2011, for related U.S. Appl. No. 11/867,629 (17 pages).

(Continued)

*Primary Examiner* — Shuangyi Abu Ali

(74) *Attorney, Agent, or Firm* — Osha Liang LLP

(57) ABSTRACT

Thermally stable diamond bonded materials and compacts include a diamond body having a thermally stable region and a PCD region, and a substrate integrally joined to the body. The thermally stable region has a microstructure comprising a plurality of diamond grains bonded together by a reaction with a reactant material. The PCD region extends from the thermally stable region and has a microstructure of bonded together diamond grains and a metal solvent catalyst disposed interstitially between the bonded diamond grains. The compact is formed by subjecting the diamond grains, reactant material, and metal solvent catalyst to a first temperature and pressure condition to form the thermally stable region, and then to a second higher temperature condition to both form the PCD region and bond the body to a desired substrate.

17 Claims, 4 Drawing Sheets

(56) References Cited

U.S. PATENT DOCUMENTS 3,233,988 A 2/1966 Wentorf, Jr. et al.
3,745,623 A 7/1973 Wentorf, Jr. et al.
4,108,614 A 8/1978 Mitchell
4,151,686 A 5/1979 Lee et al.
4,224,380 A 9/1980 Bovenkerk et al.
4,255,165 A 3/1981 Dennis et al.
4,268,276 A 5/1981 Bovenkerk
4,288,248 A 9/1981 Bovenkerk et al.
4,303,442 A 12/1981 Hara et al.
4,311,490 A 1/1982 Bovenkerk et al.
4,373,593 A 2/1983 Phaal et al.
4,387,287 A 6/1983 Marazzi
4,412,980 A 11/1983 Tsuji et al.
4,481,016 A 11/1984 Campbell et al.
4,486,286 A 12/1984 Lewin et al.
4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,636,253 A 1/1987 Nakai et al.
4,645,977 A 2/1987 Kurokawa et al.
4,662,348 A 5/1987 Hall et al.
4,664,705 A * 5/1987 Horton et al. ..... 75/243
4,670,025 A 6/1987 Pipkin
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,798,026 A 1/1989 Cerceau
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,899,922 A 2/1990 Slutz et al.
4,919,220 A 4/1990 Fuller et al.
4,940,180 A 7/1990 Martell
4,943,488 A 7/1990 Sung et al.
4,944,772 A 7/1990 Cho
4,976,324 A 12/1990 Tibbitts
4,985,051 A 1/1991 Ringwood
5,011,514 A 4/1991 Cho et al.
5,027,912 A 7/1991 Juergens
5,030,276 A 7/1991 Sung et al.
5,032,147 A 7/1991 Frushour
5,037,704 A 8/1991 Nakai et al.
5,092,687 A 3/1992 Hall
5,116,568 A 5/1992 Sung et al.
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,496,638 A 3/1996 Waldenstrom et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,718,948 A 2/1998 Ederyd et al.
5,722,499 A 3/1998 Nguyen et al.
5,776,615 A 7/1998 Wong et al.
5,833,021 A 11/1998 Mensa-Wilmot et al.
5,871,060 A 2/1999 Jensen et al.
5,875,862 A 3/1999 Jurewicz et al.
5,897,942 A 4/1999 Karner et al.
5,954,147 A 9/1999 Overstreet et al.
5,979,578 A 11/1999 Packer
6,009,963 A 1/2000 Chaves et al.
6,063,333 A 5/2000 Dennis
6,123,612 A 9/2000 Goers
6,126,741 A 10/2000 Jones et al.
6,193,001 B1 2/2001 Eyre et al.
6,234,261 B1 5/2001 Evans et al.
6,248,447 B1 6/2001 Griffin et al.
6,269,894 B1 8/2001 Griffin
6,302,225 B1 10/2001 Yoshida et al.
6,344,149 B1 2/2002 Oles
6,410,085 B1 6/2002 Griffin et al.
6,435,058 B1 8/2002 Matthias et al.
6,443,248 B2 9/2002 Yong et al.
6,544,308 B2 4/2003 Griffin et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
6,797,326 B2 * 9/2004 Griffin et al. ..... 427/343
6,951,578 B1 * 10/2005 Belnap et al. ..... 75/231
7,377,341 B2 5/2008 Middlemiss et al.
7,462,003 B2 12/2008 Middlemiss
7,473,287 B2 1/2009 Belnap et al.
7,647,992 B2 * 1/2010 Fang et al. ..... 175/374
7,647,993 B2 1/2010 Middlemiss
7,828,088 B2 * 11/2010 Middlemiss et al. ..... 175/374
7,980,334 B2 7/2011 Voronin et al.
8,057,562 B2 * 11/2011 Middlemiss ..... 51/307
2002/0023733 A1 2/2002 Hall
2002/0034631 A1 3/2002 Griffin et al.
2002/0074168 A1 6/2002 Matthias et al.
2002/0194955 A1 * 12/2002 Fang et al. ..... 75/240
2005/0050801 A1 3/2005 Cho et al.
2005/0139397 A1 6/2005 Achilles et al.
2005/0230156 A1 10/2005 Belnap et al.
2005/0263328 A1 12/2005 Middlemiss
2006/0060392 A1 3/2006 Eyre et al.
2006/0217258 A1 9/2006 Zhao
2007/0039762 A1 2/2007 Achilles
2007/0079994 A1 4/2007 Middlemiss
2007/0151769 A1 7/2007 Slutz et al.
2007/0181348 A1 8/2007 Lancaster et al.
2007/0187155 A1 8/2007 Middlemiss
2008/0073126 A1 3/2008 Shen et al.
2008/0223621 A1 9/2008 Middlemiss et al.
2009/0114454 A1 5/2009 Belnap et al.
2009/0152017 A1 6/2009 Shen et al.

FOREIGN PATENT DOCUMENTS

EP 0196777 A1 10/1986
EP 0 297 071 12/1988
EP 0297071 A1 12/1988
EP 0300699 1/1989
EP 0329954 8/1989
EP 0 352 811 1/1990

(56) References Cited

FOREIGN PATENT DOCUMENTS

| | | | | |
|---|---|---|---|---|
| EP | 0352811 | A1 | 1/1990 | |
| EP | 0 374 424 | | 6/1990 | |
| EP | 0511253 | | 8/1992 | |
| EP | 0585631 | | 3/1994 | |
| EP | 0595630 | | 5/1994 | |
| EP | 0612868 | | 8/1994 | |
| EP | 0612868 | A1 | 8/1994 | |
| EP | 0617207 | | 9/1994 | |
| EP | 0787820 | | 8/1997 | |
| EP | 0860515 | | 8/1998 | |
| EP | 1116858 | A1 | 7/2001 | |
| EP | 1190791 | | 3/2002 | |
| EP | 1190791 | A2 | 3/2002 | |
| GB | 1349385 | | 4/1974 | |
| GB | 1349685 | A | 4/1974 | |
| GB | 2006733 | * | 5/1979 | ..... B01J 3/06 |
| GB | 2048927 | | 12/1980 | |
| GB | 2 261 894 | | 6/1993 | |
| GB | 2268768 | | 1/1994 | |
| GB | 2323398 | | 9/1998 | |
| GB | 2408735 | A | 6/2005 | |
| GB | 2413813 | A | 11/2005 | |
| GB | 2427215 | A | 12/2006 | |
| GB | 2429471 | A | 2/2007 | |
| GB | 2 431 948 | | 5/2007 | |
| GB | 2431948 | A | 5/2007 | |
| GB | 2 413 813 | | 11/2008 | |
| GB | 2 408 735 | | 1/2009 | |
| GB | 2453023 | A | 3/2009 | |
| JP | 59219500 | A | 12/1984 | |
| JP | S59-218500 | | 12/1984 | |
| JP | 8176696 | | 7/1996 | |
| JP | 8176696 | A | 7/1996 | |
| RU | 2034937 | | 5/1995 | |
| RU | 2034937 | C1 | 5/1995 | |
| SU | 990486 | | 1/1983 | |
| SU | 566439 | | 1/2000 | |
| WO | 9323204 | | 11/1993 | |
| WO | 9634131 | | 10/1996 | |
| WO | 0028106 | | 5/2000 | |
| WO | 0028106 | A1 | 5/2000 | |
| WO | 2004040095 | | 5/2004 | |
| WO | 2004106003 | | 12/2004 | |
| WO | 2004106004 | | 12/2004 | |
| WO | 2007042920 | A1 | 4/2007 | |

OTHER PUBLICATIONS

Noitice of Allowance issued in related U.S. Appl. No. 11/867,629 dated Mar. 10, 2011 (23 pages).

EP Search Report issued in related European Application No. 06118267.1 dated Nov. 2, 2011 (10 pages).

Response dated Jun. 1, 2011 to EP Search Report issued in European Application No. 06118267.1 (8 pages).

Office Action issued in Canadian Application No. 2489187 dated Mar. 1, 2011(2 pages).

Examination Report issued in United Kingdom Application No. 0818022.6 dated May 26, 2011 (3 pages).

Response dated Jul. 26, 2011, to Examination Report issued in United Kingdom Application No. 0818022.6 (4 pages).

Office Action issued in Candian Application No. 2556052 dated Jun. 1, 2011 (3 pages).

Search Report for corresponding British Application No. GB0509247.3 dated Jul. 19, 2005, total 3 pages.

Office Action issued in corresponding Canadian Application No. 2,506,471 dated Mar. 14, 2012 (2 pages).

Office Action issued in corresponding Canadian Application No. 2,506,471 dated Jun. 30, 2011 (4 pages).

Nonfinal Office Action in U.S. Appl. No. 11/857,334 dated Mar. 3, 2010.

Final Office Action issued in U.S. Appl. No. 11/122,541 dated May 21, 2009 (8 pages).

Office Action issued in U.S. Appl. No. 11/857,334 dated Mar. 3, 2010 (40 pages).

Search Report issued in United Kingdom Application No. GB0815944.4 dated Jan. 9, 2009 (3 pages).

* cited by examiner

FIG. 4
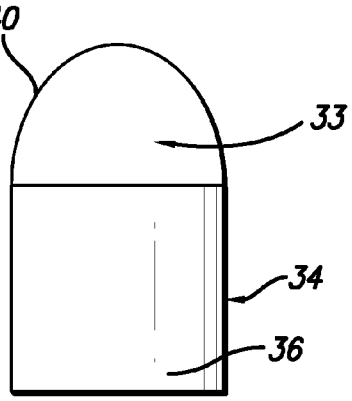
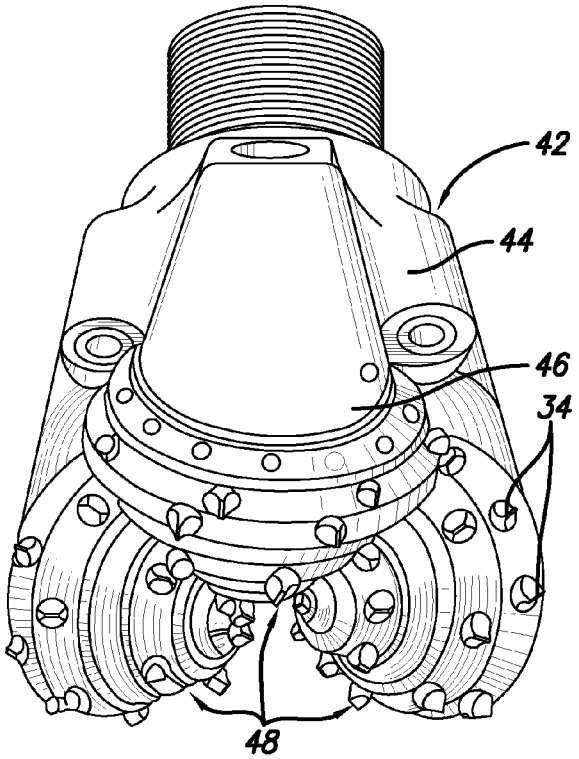
FIG. 5
FIG. 6
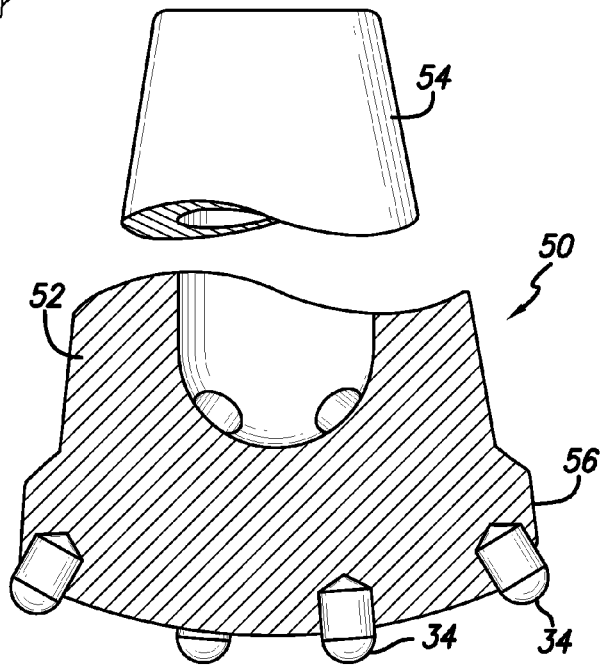

THERMALLY STABLE DIAMOND BONDED MATERIALS AND COMPACTS

CROSS-REFERENCE TO RELATED APPLICATIONS

This application is a divisional of U.S. patent application Ser. No. 11/122,541 filed May 4, 2005, which claims the benefit of U.S. Provisional Application No. 60/568,893 filed May 6, 2004, which are herein incorporated by reference in their entirety.

FIELD OF THE INVENTION

This invention generally relates to diamond bonded materials and, more specifically, diamond bonded materials and compacts formed therefrom that are specially designed to provide improved thermal stability when compared to conventional polycrystalline diamond materials.

BACKGROUND OF THE INVENTION

Polycrystalline diamond (PCD) materials and PCD elements formed therefrom are well known in the art. Conventional PCD is formed by combining diamond grains with a suitable solvent catalyst material to form a mixture. The mixture is subjected to processing conditions of extremely high pressure/high temperature, where the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials that are typically used for forming conventional PCD include metals from Group VIII of the Periodic table, with cobalt (Co) being the most common. Conventional PCD can comprise from 85 to 95% by volume diamond and a remaining amount of the solvent catalyst material. The solvent catalyst material is present in the microstructure of the PCD material within interstices that exist between the bonded together diamond grains.

A problem known to exist with such conventional PCD materials is thermal degradation due to differential thermal expansion characteristics between the interstitial solvent catalyst material and the intercrystalline bonded diamond. Such differential thermal expansion is known to occur at temperatures of about 400° C., causing ruptures to occur in the diamond-to-diamond bonding, and resulting in the formation of cracks and chips in the PCD structure.

Another problem known to exist with conventional PCD materials is also related to the presence of the solvent catalyst material in the interstitial regions and the adherence of the solvent catalyst to the diamond crystals to cause another form of thermal degradation. Specifically, the solvent catalyst material is known to cause an undesired catalyzed phase transformation in diamond (converting it to carbon monoxide, carbon dioxide, or graphite) with increasing temperature, thereby limiting practical use of the PCD material to about 750° C.

Attempts at addressing such unwanted forms of thermal degradation in PCD are known in the art. Generally, these attempts have involved the formation of a PCD body having an improved degree of thermal stability when compared to the conventional PCD material discussed above. One known technique of producing a thermally stable PCD body involves at least a two-stage process of first forming a conventional sintered PCD body, by combining diamond grains and a cobalt solvent catalyst material and subjecting the same to high pressure/high temperature process, and then removing the solvent catalyst material therefrom.

This method, which is fairly time consuming, produces a resulting PCD body that is substantially free of the solvent catalyst material, and is therefore promoted as providing a PCD body having improved thermal stability. However, the resulting thermally stable PCD body typically does not include a metallic substrate attached thereto by solvent catalyst infiltration from such substrate due to the solvent catalyst removal process. The thermally stable PCD body also has a coefficient of thermal expansion that is sufficiently different from that of conventional substrate materials (such as WC—Co and the like) that are typically infiltrated or otherwise attached to the PCD body to provide a PCD compact that adapts the PCD body for use in many desirable applications. This difference in thermal expansion between the thermally stable PCD body and the substrate, and the poor wetability of the thermally stable PCD body diamond surface makes it very difficult to bond the thermally stable PCD body to conventionally used substrates, thereby requiring that the PCD body itself be attached or mounted directly to a device for use.

However, since such conventional thermally stable PCD body is devoid of a metallic substrate, it cannot (e.g., when configured for use as a drill bit cutter) be attached to a drill bit by conventional brazing process. The use of such thermally stable PCD body in this particular application necessitates that the PCD body itself be mounted to the drill bit by mechanical or interference fit during manufacturing of the drill bit, which is labor intensive, time consuming, and which does not provide a most secure method of attachment.

Additionally, because such conventional thermally stable PCD body no longer includes the solvent catalyst material, it is known to be relatively brittle and have poor impact strength, thereby limiting its use to less extreme or severe applications and making such thermally stable PCD bodies generally unsuited for use in aggressive applications such as subterranean drilling and the like.

It is, therefore, desired that a diamond material be developed that has improved thermal stability when compared to conventional PCD materials. It is also desired that a diamond compact be developed that includes a thermally stable diamond material bonded to a suitable substrate to facilitate attachment of the compact to an application device by conventional method such as welding or brazing and the like. It is further desired that such thermally stable diamond material and compact formed therefrom have improved properties of hardness/toughness and impact strength when compared to conventional thermally stable PCD material described above, and PCD compacts formed therefrom. It is further desired that such a product can be manufactured at reasonable cost without requiring excessive manufacturing times and without the use of exotic materials or techniques.

SUMMARY OF THE INVENTION

Thermally stable diamond bonded materials of this invention generally comprise a diamond bonded body including a thermally stable region and a PCD region. Thermally stable diamond bonded materials of this invention may additionally comprise a substrate attached or integrally joined to the diamond bonded body, thereby providing a thermally stable diamond bonded compact.

The diamond body thermally stable region extends a distance below a surface, e.g., a working surface, of the diamond bonded body, and has a material microstructure comprising a plurality of diamond grains bonded together by a reaction with a reactant material. The diamond body thermally stable region can be formed by placing the reactant material adjacent a region of diamond grains, or by mixing the reactant material together with the diamond grains in a particular region, to become thermally stable during high pressure/high temperature processing.

The PCD region extends a depth within the diamond body from the thermally stable region and has a material microstructure comprising intercrystalline bonded together diamond grains and a metal solvent catalyst disposed within interstitial regions between the bonded together diamond grains. The PCD region can be formed by subjecting a region of diamond grains in the body distinct from the thermally stable region to infiltration by a suitable infiltrant, e.g., a metal solvent catalyst, that may be provided for example from a substrate used for attaching to the diamond body to form a thermally stable diamond bonded compact.

Reactant materials useful for forming thermally stable diamond bonded materials of this invention include those that are capable of reacting with the diamond grains at a temperature that is below the melting temperature of the infiltrant used to form the PCD region, thereby permitting the formation of the diamond body comprising such different thermally stable and PCD regions during a single press operation. In an example embodiment, thermally stable diamond bonded compacts of this invention are prepared by placing an assembly comprising the volume of diamond grains, reactant material, infiltrant, and substrate in a high pressure/high temperature device, and subjecting the assembly to a first temperature and pressure condition to facilitate melting, infiltration and reaction of the reactant material with the region of the diamond grains targeted to become thermally stable. Without removing the assembly from the device, it is then subjected to a second temperature condition to cause the infiltration of the infiltrant into the diamond grains within a second targeted region of the body to facilitate diamond bonding to form PCD. During this second temperature condition, the so-formed diamond body is also bonded or joined to the substrate, thereby forming the compact.

Thermally stable diamond bonded materials and compacts formed therefrom according to principles of this invention have improved thermal stability when compared to conventional PCD materials, and include a suitable substrate to facilitate attachment of the compact to an application device by conventional method such as welding or brazing and the like. Thermally stable diamond materials and compacts formed therefrom have improved properties of hardness/toughness and impact strength when compared to conventional thermally stable PCD material described above, and PCD compacts formed therefrom.

BRIEF DESCRIPTION OF THE DRAWINGS

These and other features and advantages of the present invention will be appreciated as the same becomes better understood by reference to the following detailed description when considered in connection with the accompanying drawings wherein:

FIG. 4 is a perspective side view of an insert, for use in a roller cone or a hammer drill bit, comprising the thermally stable diamond bonded compact of FIGS. 3A and 3B;

FIG. 5 is a perspective side view of a roller cone drill bit comprising a number of the inserts of FIG. 4;

FIG. 6 is a perspective side view of a percussion or hammer bit comprising a number of inserts of FIG. 4;

DETAILED DESCRIPTION

Thermally stable diamond bonded materials and compacts of this invention are specifically engineered having a diamond bonded body comprising a thermally stable diamond bonded region, thereby providing improved thermal stability when compared to conventional PCD materials. As used herein, the term PCD is used to refer to polycrystalline diamond that has been formed, at high pressure/high temperature (HPHT) conditions, through the use of a metal solvent catalyst, such as those metals included in Group VIII of the Periodic table. The thermally stable diamond bonded region in diamond bonded bodies of this invention, is not referred to as being PCD because, unlike conventional PCD and thermally stable PCD, it is not formed by the removal of a metal solvent catalyst.

Thermally stable diamond bonded materials and compacts of this invention also include a region comprising conventional PCD, i.e., intercrystalline bonded diamond formed using a metal solvent catalyst, thereby providing properties of hardness/toughness and impact strength that are superior to conventional thermally stable PCD materials that have been rendered thermally stable by having substantially all of the solvent catalyst material removed. Such PCD region also enables thermally stable diamond bonded materials of this invention to be permanently attached to a substrate by virtue of the presence of such metal solvent catalyst, thereby enabling thermally stable diamond bonded compacts of this invention to be attached to cutting or wear devices, e.g., drill bits when the diamond compact is configured as a cutter, by conventional means such as by brazing and the like.

Thermally stable diamond bonded materials and compacts of this invention are formed during a single HPHT process to produce a desired thermally stable diamond bonded material in one region of the body, while also providing PCD in another region to provide a permanent attachment between the diamond bonded body and a desired substrate.

Figure 1:
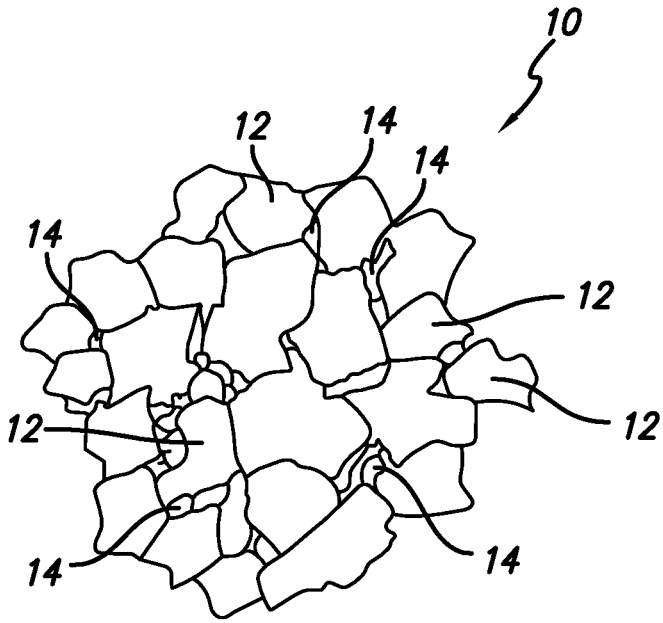
FIG. 1 is schematic view taken from a thermally stable region of a diamond bonded material of this invention.

FIG. 1 illustrates a region of a thermally stable diamond bonded material 10 of this invention having a material microstructure comprising the following material phases. A first material phase 12 comprises intercrystalline bonded diamond that is formed by the bonding together of adjacent diamond grains at HPHT. A second material phase 14 is disposed interstitially between bonded together diamond grains and comprises a reaction product of a preselected material with the diamond that functions to bond the diamond grains together. Accordingly, the material microstructure of this region comprises a distribution of both intercrystalline bonded diamond, and diamond grains that are bonded together by reaction with the preselected bonding agent.

Diamond grains useful for forming thermally stable diamond bonded materials of this invention include synthetic diamond powders having an average diameter grain size in the range of from submicrometer in size to 100 micrometers, and more preferably in the range of from about 5 to 80 micrometers. The diamond powder can contain grains having a mono or multi-modal size distribution. In an example embodiment, the diamond powder has an average particle grain sized of approximately 20 micrometers. In the event that diamond powders are used having differently sized grains, the diamond grains are mixed together by conventional process, such as by ball or attrittor milling for as much time as necessary to ensure good uniform distribution.

The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device. In an example embodiment where the diamond bonded body is to be attached to a substrate, a suitable substrate material is disposed within the consolidation and sintering device adjacent the diamond powder mixture.

In a preferred embodiment, the substrate is provided in a preformed state and includes a metal solvent catalyst that is capable of infiltrating into the adjacent diamond powder mixture during processing. Suitable metal solvent catalyst materials include those metals selected from Group VIII elements of the Periodic table. A particularly preferred metal solvent catalyst is cobalt (Co).

The substrate material can be selected from the group of materials conventionally used as substrate materials for forming conventional PCD compacts. In a preferred embodiment, the substrate material comprises cemented tungsten carbide (WC—Co).

It is desired that a predetermined region of the diamond bonded body formed during the consolidation and sintering process become thermally stable. It is further desired that a predetermined region of the diamond body formed during the same process also form a desired attachment with the substrate. In an example embodiment, the predetermined region to become thermally stable is one that will form the wear or cutting surface of the final product.

In a first invention embodiment, a suitable first or initial stage infiltrant is disposed adjacent a surface portion of the predetermined region of the diamond powder to become thermally stable. The first infiltrant can be selected from those materials having a melting temperature that is below the melting temperature of the metal solvent catalyst in the substrate, that are capable of infiltrating the diamond powder mixture upon melting during processing, and that are capable of bonding together the diamond grains. In an example embodiment, the first infiltrant actually participates in the bonding process, forming a reaction product that bonds the diamond grains together.

In a preferred first embodiment, the first infiltrant is a silicon material that is provided in a form suitable for placement and use within the consolidation and sintering device. In an example embodiment, the silicon material can be provided in the form of a silicon metal foil or powder, or in the form of a compacted green powder. The first infiltrant is positioned within the device adjacent the surface of the predetermined region of the diamond powder to become thermally stable. In an example embodiment, the first infiltrant is positioned adjacent the diamond powder during assembly of the container prior to its placement into the HPHT consolidation and sintering device.

The device is then activated to subject the container to a desired HPHT condition to effect consolidation and sintering. In an example embodiment, the device is controlled so that the container is subjected to a HPHT process where the applied pressure and temperature is first held at a suitable intermediate level for a period of time sufficient to melt the first infiltrant, e.g., a silicon material, and allow the first infiltrant to infiltrate into the diamond powder mixture and react with and bond together the diamond grains. In such example embodiment, the intermediate level can be at a pressure of approximately 5500 MPa, and at a temperature of from 1150° C. to 1300° C. It is to be understood that the particular intermediate pressure and temperatures presented above are based on using a silicon metal first infiltrant and a specific type and volume of diamond powder. Accordingly, pressures and/or temperatures other than those noted above may be useful for other types of infiltrants and/or other types and volumes of diamond powder.

The use of temperatures below this range may not be well suited for the intermediate level, when silicon metal is chosen as the first infiltrant, because at lower temperatures the silicon metal may not melt, and thus not infiltrate into the diamond mixture as desired. Using a temperature above this range may not be desired for the intermediate level because, although the first infiltrant will melt and infiltrate into the diamond powder mixture, such higher temperature may also cause a second stage infiltrant, i.e., the metal solvent catalyst in the substrate (e.g., cobalt), to melt and infiltrate the diamond grains at the same time.

Infiltration of the metal solvent catalyst prior to or at the same time as infiltration of the first infiltrant, e.g., silicon metal, is not desired because it can initiate unwanted conventional diamond sintering throughout the diamond body. Such conventional diamond sintering operates to inhibit infiltration into the diamond mixture by the first stage infiltrant, thereby preventing reaction of the first infiltrant with the diamond grains to preclude formation of the desired thermally stable diamond region.

During this intermediate stage of processing, the first infiltrant melts and infiltrates into the adjacent surface of the diamond mixture. In the case where the first infiltrant is a silicon metal, it then reacts with the diamond grains to form silicon carbide (SiC) between the diamond particles in the adjacent region of the compact. In such example embodiment, where silicon is provided as the selected first infiltrant, it is desired that the intermediate level of processing be held for a period of time of from 2 to 20 minutes. This time period must be sufficient to melt all of the silicon, allow the melted silicon to infiltrate the diamond powder, and allow the infiltrated silicon to react with the diamond to form the desired SiC, thereby bonding the diamond particles together. It is desired that substantially all of the silicon infiltrant be reacted, as silicon metal is known to be brittle and any residual unreacted silicon metal in the diamond can have a deleterious effect on the final properties of the resulting thermally stable diamond bonded compact.

While particular intermediate level pressures, temperatures and times have been provided, it is to be understood that one or more of these process variables may change depending on such factors as the type and amount of infiltrant and/or diamond powder that is selected. A key point, however, is that the temperature for the intermediate level be below the melting temperature of the second stage infiltrant, i.e., the metal solvent catalyst in the substrate, to permit the first stage infiltrant to infiltrate and react with the diamond powder prior to melting and infiltration of the metal solvent catalyst.

In an example embodiment, where the thermally stable diamond bonded compact being formed according to this invention will be embodied as a diamond cutter, the first infiltrant is provided in the form of a silicon metal foil that is positioned adjacent what will be a working or cutting surface of the to-be-formed diamond bonded body, and the silicon infiltrates the diamond body a desired depth from the working surface, thereby providing a desired thermally stable diamond bonded region extending the desired depth from the working surface. In such example embodiment, the silicon may infiltrate the diamond powder a depth from the working surface of from 1 to 1,000 micrometers, and preferably at least 10 micrometers. In an example embodiment, the silicon may infiltrate the diamond powder a depth from the working surface of from about 20 to 500 micrometers.

A key feature of thermally stable diamond bonded materials and compacts of this invention is that the thermally stable region of the diamond body is formed in a single process step without the presence or assistance of a conventional metal solvent catalyst, such as cobalt, and without the need for subsequent processing to remove the metal solvent catalyst. Rather, the thermally stable region is formed by the infiltration and reaction of a first stage infiltrant, such as silicon, into the diamond powder during HPHT processing to produce a bonded reaction product between the diamond grains.

After the desired time has passed during the intermediate level, the consolidation and sintering process is continued by increasing the temperature to a range of from about 1350° C. to 1500° C. The pressure for this secondary processing step is preferably maintained at the same level as noted above for the intermediate level. At this temperature, the second stage infiltrant in the form of the metal solvent catalyst component in the substrate melts and infiltrates into an adjacent region of the diamond powder mixture, thereby sintering the adjacent diamond grains in this region by conventional method to form conventional PCD in this region, and forming a desired attachment or bond between the PCD region of the diamond bonded body and the substrate.

While a particular temperature range for this secondary phase of processing has been provided, it is to be understood that such secondary processing temperature can and will vary depending on such factors as the type and/or amount of metal solvent catalyst used in the substrate, as well as the type and/or amount of diamond powder used to form the diamond bonded body.

In the example embodiment discussed above, where the diamond bonded compact is configured for use as a cutter, the region of the compact body that is secondarily infiltrated with the metal solvent catalyst component from the substrate is positioned adjacent a surface of the diamond mixture opposite from the working surface, and it is desired that the metal solvent catalyst infiltration depth be sufficient to provide a secure bonded attachment between the substrate and diamond bonded body.

During this secondary or final phase of the HPHT processing, the metal solvent catalyst, e.g., cobalt, infiltrates between the diamond grains in the region of the diamond powder adjacent the substrate to provide highly localized catalysis for the rapid creation of strong bonds between the diamond grains or crystals, i.e., producing intercrystalline bonded diamond or conventional PCD. As these bonds are formed, the cobalt moves into and remains disposed within interstitial regions between the intercrystalline bonded diamond.

While there may be some possibility that, during this secondary phase of processing, the metal solvent catalyst from the substrate may infiltrate into the diamond powder to a point where it passes into the thermally stable region of the diamond bonded body, there is no indication that reactions between the metal solvent catalyst and any unreacted infiltrant, e.g., silicon, or reactions between the metal solvent catalyst and the infiltrant reaction product, e.g., silicon carbide, takes place or if it does has had any deleterious effect on the final properties of the diamond bonded body.

As noted above, when the first stage infiltrant selected for forming the thermal stable diamond region is silicon, the infiltrated silicone forms a reaction phase with the diamond grains, crystals or particles in the diamond bonded phase according to the reaction:

$$Si+C=SiC$$

This reaction between silicon and carbon present in the diamond grains, crystals or particles is desired as the reaction product; namely, silicon carbide is a ceramic material that has a coefficient of thermal expansion that is similar to diamond. At the interface within the diamond bonded body between the thermally stable diamond bonded region and the PCD region, where both cobalt and silicon carbide may be present, reactions such as the following may take place: $Co+2SiC=CoSi_2+2C$. This, however, is not a concern and may be advantageous as $CoSi_2$ is also known to be a thermally stable compound.

Additionally, if the Co and SiC do not end up reacting together at the boundary or interface between the two regions, the presence of the silicon carbide adjacent the PCD region operates to minimize or dilute the otherwise large difference in the coefficient of thermal expansion that would otherwise exist between the intercrystalline diamond and the cobalt phases in PCD region. Thus, the formation of silicon carbide within the silicon-infiltrated region of the diamond bonded body operates to minimize the development of thermal stress in that region and at the boundary between the Si and Co infiltrated regions, thereby improving the overall thermal stability of the entire diamond bonded body.

As noted above, the first stage infiltrant operates to provide a thermally stable diamond bonded region through the formation of a reaction product that actually forms a bond with diamond crystals. While a certain amount of diamond-to-diamond bonding can also occur within this thermally stable diamond region without the benefit of the second stage solvent-catalyst infiltrant, it is theorized that such direct diamond-to-diamond bonding represents a minority of the diamond bonding that occurs in this region. In an example embodiment, where the first stage infiltrant being used is silicon, it is believed that greater than about 75 percent, and more preferably 85 percent or more, of the diamond bonding occurring in the thermally stable region is provided by reaction of the diamond grains or particles with the first stage infiltrant.

While ideally, it is desired that all of the diamond bonding in the thermally stable region be provided by reaction with the first stage infiltrant, any amount of diamond-to-diamond bonding occurring in the thermally stable region occurs without the presence or use of a metal solvent catalyst, thus the resulting diamond bonded region is one having a degree of thermal stability that is superior to conventional PCD.

It is to be understood that the amount of the first stage infiltrant used during processing can and will vary depending on such factors as the size of the diamond grains that are used, the volume of diamond grains and region/volume of desired thermal stability, the amount and/or type of the first stage infiltrant material itself, in addition to the particular application for the resulting diamond bonded compact. Additionally, the amount of the first stage infiltrant used must be precisely determined for the purpose of infiltrating and reacting with a desired volume of the diamond powder to provide a desired thermally stable diamond region, e.g., a desired thermally stable diamond depth.

For example, using an excessive amount of the first stage infiltrant, e.g., silicon, to react with the diamond powder during intermediate stage processing can result in excess infiltrant being present during secondary or final processing when the second stage metal solvent catalyst infiltrant e.g., cobalt, in the substrates melts, infiltrates, and facilitates conventional diamond sintering adjacent the substrate. Excess first stage infiltrant present during this secondary phase of processing can remain unreacted as a brittle silicon phase or can react with the metal solvent catalyst material to form cobalt disilicide ($CoSi_2$) at the boundary between the two regions.

In addition to silicon, the thermally stable region of first embodiment diamond bonded materials and compacts of this invention can be formed from other types of first stage materials. Such materials must be capable of melting or of reacting with diamond in the solid state during processing of the diamond bonded materials at a temperature that is below the melting temperature of the metal solvent catalyst component in the metallic substrate. Additionally, such first stage material must, upon reacting with the diamond, form a compound having a coefficient of thermal expansion that is relatively closer to that of diamond than that of the metal solvent catalyst. It is also desired that the compound formed by reaction with diamond be capable of bonding with the diamond and must possess significantly high-strength characteristics.

In an example embodiment, the source of silicon that is used for initial infiltration is provided in the form of a silicon metal disk. As noted above, the amount of silicon that is used can influence the depth of infiltration as well as the resulting types of silicon compounds that can be formed. In an example embodiment, where the volume of the diamond bonded body to become thermally stable is within the range of from about 50 to 400 cubic mm, it is desired that the amount of silicon infiltrant be in the range of from about 10 to 80 milligrams. In a preferred embodiment, where the desired silicon infiltration volume is approximately 100 cubic mm, the amount of silicon infiltrant to be used is approximately 23 milligrams.

A second embodiment thermally stable diamond bonded compact of this invention can be formed by mixing diamond powder together with a preselected material capable of participating in solid state reactions with the diamond powder. Thus, unlike the first embodiment described above, the preselected materials useful for forming the thermally stable region in this second embodiment is provided in situ with the diamond powder and is not positioned adjacent a surface of the diamond powder as an initial infiltrant.

Suitable preselected materials useful for forming second embodiment thermally stable diamond bonded compacts include those compounds or materials capable of forming a bond with the diamond grains, have a coefficient of thermal expansion that is relatively closer to that of the diamond grains than that of a conventional metal solvent catalyst, that is capable of reacting with the diamond at a temperature that is below that of the melting temperature of the metal solvent catalyst contained in the substrate, and that is capable of forming an attachment with an adjacent diamond region in the diamond body.

Example preselected materials useful for forming the second invention embodiment include ceramic materials such as TiC, $Al_2O_3$, $Si_3N_4$ and the like. These ceramic materials are known to bond with the diamond grains to form a diamond-ceramic microstructure. In an example embodiment, the volume percent of diamond grains in this mixture is in the range of from about 50 to 95 volume percent. Again, a key feature of this second embodiment of the invention is the ability to form both a thermally stable diamond region and a conventional PCD region in the diamond body during a single HPHT process.

Since the preselected material used to bond the diamond grains together in this second embodiment is mixed together with the diamond grains, the solid state reaction of these materials during HPHT processing operates to form thermally stable diamond within the entire region of the diamond body that was formally occupied by the diamond mixture. In other words, conventional PCD is not formed within this region.

To accommodate attachment of a desired substrate to the thermally stable region of the diamond body, second embodiments of this invention further include use of a green-state diamond grain material disposed adjacent the diamond grain mixture. The green-state diamond grain material may or may not include a metal solvent catalyst. Additionally the green-state diamond grain material can be provided in the form of a single layer of material or in the form of multiple layers of materials. Each layer may include the same or different diamond grain size, diamond volume, and may or may not include the use of a solvent catalyst. In an example embodiment, the green-state diamond grain material can be provided in the form of one or more layers of conventional diamond tape.

Thus, second embodiment thermally stable diamond compacts of this invention are formed by mixing together diamond grains, as described above, with the desired preselected material for reacting with the diamond grains as noted above. The mixture can be cleaned in the manner noted above and loaded into a desired container for placement within the HPHT device. The green-state diamond grain-containing material is positioned adjacent the mixture. In an example embodiment where the diamond bonded body is to be attached to a substrate, a substrate material as noted above is positioned adjacent the green-state diamond grain-containing material.

The container is placed in the HPHT device and the device is activated to affect consolidation and sintering. Like the process described above of forming the first invention embodiment, the device is controlled so that the container and its contents is subjected to a HPHT condition wherein the pressure and/or temperature is first held at a suitable intermediate level for a period of time sufficient to cause the desired solid state reaction to occur within the mixture of diamond grains and the preselected material. Subsequently, the HPHT condition is changed to a different pressure and/or temperature. At this subsequent HPHT condition, any solvent catalyst in the green-state diamond grain material melts and facilitates diamond-diamond bonding to form conventional PCD within this region. Also, the two adjacent diamond regions will become attached to one another, and the solvent catalyst in the substrate will melt and infiltrate the adjacent green-state material to form a desired attachment or bond between the PCD region of the diamond body and the substrate.

In this second embodiment, the intermediate HPHT process conditions are such that will cause the diamond grains and preselected material mixture to undergo solid state reactions to form a thermally stable diamond-ceramic phase. The specific pressure and temperature for this intermediate HPHT condition can and will vary depending on the particular nature of the preselected material that is used to react with the diamond grains. Again, a key processing point here is that the temperature at this intermediate HPHT condition be below the melting point of any solvent catalyst present in the adjacent green-state diamond material, and present in the substrate, to ensure formation of the thermally stable diamond region prior to the melting and infiltration of the solvent catalyst.

In an example embodiment where the preselected material is $Al_2O_3$, and the diamond powder used is the same as that described above for the first invention embodiment, the intermediate HPHT process can be conducted at a pressure of approximately 5500 MPa, and at a temperature of from 1250° C. to 1300° C. The intermediate level of HPHT processing can be held for a period of time of from about 10 to 60 minutes to facilitate plastic deformation and filling of the voids between the diamond grains by the ceramic powder and initiation of solid state reactions of the ceramic with the diamond particles. Again, it is to be understood that the intermediate HPHT conditions provided above are based on using $Al_2O_3$ as the preselected material and a specific size and volume of diamond powder. Accordingly, pressure and/or temperatures other than those noted above may be useful for other types of preselected materials and/or other types and/or volumes of diamond powder.

Once the intermediate level HPHT processing has been completed, the HPHT process is changed to facilitate further consolidation and sintering by increasing the temperature to a point where any solvent catalyst present in the green-state material region, and the solvent catalyst in the substrate, melts. When the solvent catalyst is cobalt, the temperature is increased to about 1350° C. to 1500° C. The pressure at this subsequent HPHT process condition is maintained at the same level as noted above for the intermediate HPHT process condition.

As noted above, at this temperature all or a portion of the green-state diamond material becomes PCD. In the event that the green-state diamond material itself includes a solvent catalyst, then the entire region occupied by the green-state diamond becomes PCD. If the green-state diamond material does not include a solvent catalyst, then at least the portion of the region occupied by the green-state diamond adjacent the substrate becomes PCD by virtue of solvent catalyst infiltration from the substrate. In either case, at this temperature solvent catalyst from the substrate infiltrates the adjacent portion of the green-state material and the substrate becomes attached or bonded thereto.

In this embodiment where a ceramic material is used as a second phase binder material between the diamond grains forming the thermally stable material, a further HPHT process step at higher temperatures and/or pressures than the previous stages may be desirable to encourage the formation of good sintering of the ceramic phase and reaction with the diamond. In the example embodiment where the preselected material is $Al_2O_3$, the final HPHT process may be conducted at a pressure of approximately 5500 MPa and at a temperature of 1500° C. to 1700° C.

A feature of thermally stable diamond bonded material prepared according to this second invention embodiment is that, like the first invention embodiment, it can be formed during a single HPHT process, i.e., unlike conventional thermally stable diamond that requires the multi-step process of forming conventional PCD, and then removing the solvent catalyst therefrom. Additionally, like the first invention embodiment, the second invention embodiment of this invention comprises a thermally stable diamond bonded material generally comprising a thermally stable diamond bonded region, a conventional PCD region, and a substrate attached thereto to facilitate attachment of the diamond body to a desired device by conventional means such as brazing at the like.

Figure 2:
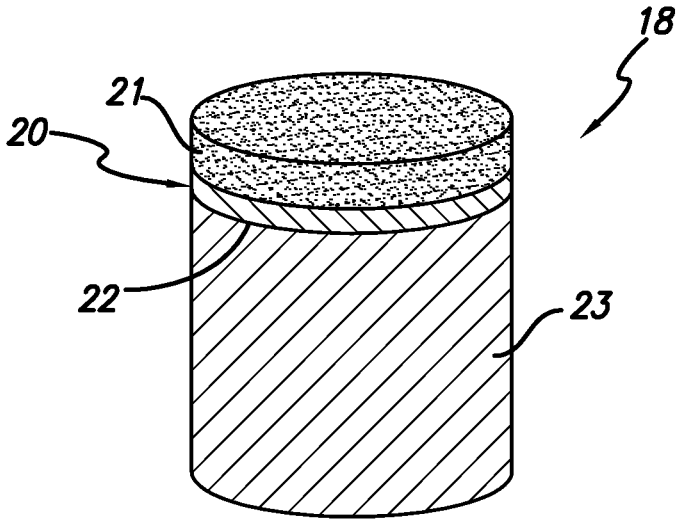
FIG. 2 is a perspective view of a thermally stable diamond bonded compact of this invention comprising a diamond bonded body and a substrate bonded thereto.

FIG. 2 illustrates a schematic diagram of a thermally stable diamond bonded compact 18 constructed according to principles of this invention disclosed above. Generally speaking, such compact 18 comprises a diamond bonded body 20 having the thermally stable diamond region 21 described, a conventional PCD region 22, and a metallic substrate 23 attached to the PCD region. While the diamond bonded compact 18 is illustrated as having a certain configuration, it is to be understood that diamond bonded compacts of this invention can be configured having a variety of different shapes and sizes depending on the particular wear and/or cutting application.

Figure 3A:
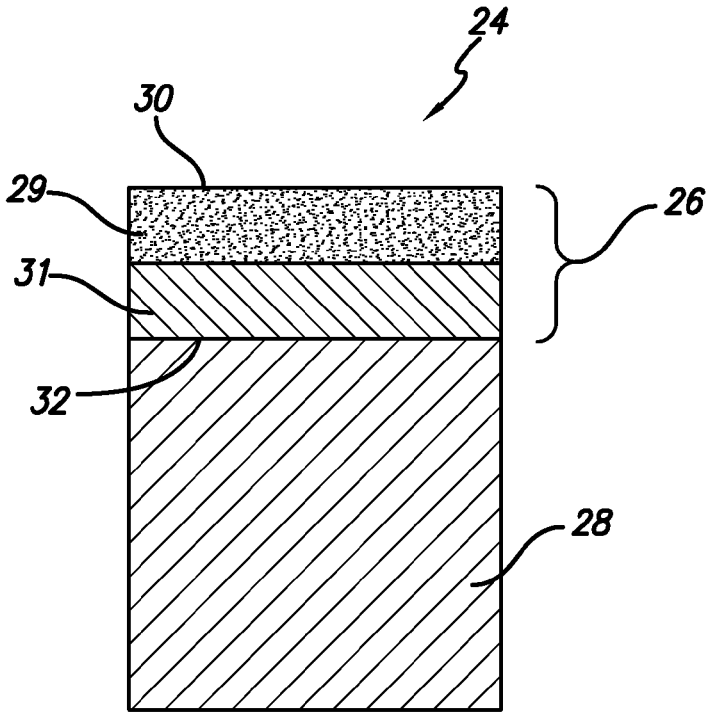
FIGS. 3A and 3B are cross-sectional schematic views of the thermally stable diamond bonded compacts of FIG. 2.
Figure 3B:
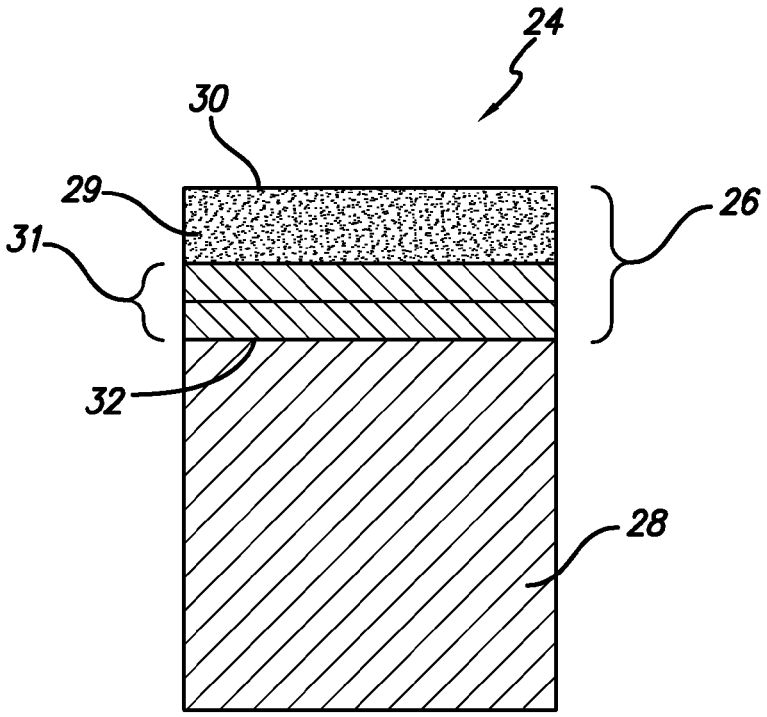

FIGS. 3A and 3B illustrate a cross-sectional side view of a thermally stable diamond bonded compacts 24 of this invention, each comprising a diamond bonded body 26 that is attached to a metallic substrate 28. The diamond bonded body 26 comprises a thermally stable region 29, extending a depth from a surface 30 of the diamond bonded body, that is formed according to the two invention embodiments described above. For example, in a first invention embodiment the thermally stable region is provided by infiltrating a suitable first stage infiltrant material therein to bond the diamond grains together by reacting with the infiltrant. In a second invention embodiment, the thermally stable region is provided by mixing a preselected material with the diamond powder to affect solid state reaction with the diamond grains.

In each invention embodiment, the thermally stable region 29 has a material microstructure comprising primarily diamond crystals bonded together by the reaction product of the initial infiltrant or preselected material, and to a lesser extent diamond-diamond bonded crystals, as best illustrated in FIG. 1. As noted above, this region 29 has an improved degree of thermal stability when compared to conventional PCD, due both to the absence of any conventional metal solvent catalyst and to the presence of the reaction product between the diamond and the preselected material, as this reaction product has a coefficient of thermal expansion that more closely matches diamond as contrasted to a solvent catalyst, e.g., cobalt.

The diamond bonded body 26 includes another region 31, a conventional PCD region that extends a depth from the thermally stable region 29 through the body 26 to an interface 32 between the diamond bonded body and the substrate 28. In the first embodiment of the invention, this conventional PCD region 31 is formed by infiltration of the solvent catalyst into a portion of the diamond grains powder that is adjacent the substrate. In the second embodiment of the invention, this conventional PCD region 31 is formed within the green-state diamond grain material either by the presence of solvent catalyst therein or by infiltration of the solvent catalyst from the substrate.

FIG. 3A illustrates thermally stable diamond bonded compact 34 that can be formed according to the first and second embodiments of this invention. In a first embodiment, where the PCD region 31 is formed by solvent metal infiltration into the diamond grain powder from the substrate, this region will include an increasing amount of metal solvent catalyst moving from the thermally stable region 20 to the substrate 28. As noted above, such metal solvent catalyst infiltration operates to ensure a desired attachment between the diamond body and the substrate, thereby ensuring use and attachment of the resulting diamond bonded compact to a desired application device by conventional means like brazing.

In a second embodiment, where the PCD region 31 is formed by sintering of the green-state diamond grain material, the amount of solvent catalyst material may also increase moving towards the substrate due to solvent catalyst infiltration into the adjacent portion of the green-state diamond grain material during second phase HPHT processing.

FIG. 3B illustrates a thermally stable diamond bonded compact 24 prepared according to the second embodiment of the invention as described above, wherein instead of being formed from a single layer of green-state diamond grain material it is prepared using more than one layer, in this case two layers 31. During the second stage HPHT processing, the two or more green-state diamond grain material layers are bonded together, e.g., by solvent metal infiltration, adjacent diamond-to-diamond bonding, and the like. If desired, the diamond density, and/or diamond grain size, and/or use of solvent catalyst in the two green-state layers used to form this embodiment can vary depending on the particular desired performance characteristics.

Substrates useful for forming thermally stable diamond bonded materials and compacts of this invention can be selected from the same general types of materials conventionally used to form substrates for conventional PCD materials, including carbides, nitrides, carbonitrides, cermet materials, and mixtures thereof A key feature is that the substrate includes a metal solvent catalyst that melts at a temperature above the melting or reaction temperature of the matrix material mixed with the diamond powder used to form the thermally stable layer. The purpose of the metal solvent catalyst in the substrate is to melt and infiltrate into the adjacent diamond grain region of the diamond body to both facilitate conventional diamond-to-diamond intercrystalline bonding forming PCD, and to form a secure attachment between the diamond bonded body and the substrate. In an example embodiment, the substrate can be formed from cemented tungsten carbide (WC—Co).

The above-described thermally stable diamond bonded materials and compacts formed therefrom will be better understood with reference to the following examples:

EXAMPLE 1

Thermally Stable Diamond Bonded Compact—First Embodiment

Synthetic diamond powders having an average grain size of approximately 2-50 micrometers were mixed together for a period of approximately 2-6 hours by ball milling. The resulting mixture was cleaned by heating to a temperature in excess of 850° C. under vacuum. The mixture was loaded into a refractory metal container with a first stage infiltrant in the form of a silicon metal disk adjacent to a predetermined working or cutting surface of the resulting diamond bonded body. A WC—Co substrate was positioned adjacent an opposite surface of the resulting diamond bonded body. The container was surrounded by pressed salt (NaCl) and this arrangement was placed within a graphite heating element. This graphite heating element containing the pressed salt and the diamond powder and substrate encapsulated in the refractory container was then loaded in a vessel made of a high-temperature/high-pressure self-sealing powdered ceramic material formed by cold pressing into a suitable shape.

The self-sealing powdered ceramic vessel was placed in a hydraulic press having one or more rams that press anvils into a central cavity. The press was operated to impose an intermediate stage processing pressure and temperature condition of approximately 5500 MPa and approximately 1250° C. on the vessel for a period of approximately 10 minutes. During this intermediate stage HPHT processing, the silicon from the silicon metal disk melted and infiltrated into an adjacent region of the blended diamond powder mixture, and formed SiC by reaction with the diamond in the blended mixture, thereby bonding the diamond grains together.

The press was subsequently operated at constant pressure to impose an increased final temperature of approximately 1450° C. on the vessel for a period of approximately 20 minutes. During this final stage HPHT processing, cobalt from the WC—Co substrate infiltrated into an adjacent region of the blended diamond mixture, and intercrystalline bonding between the diamond crystals, and between the diamond crystals and SiC along the interface between the regions took place, thereby forming conventional PCD.

The vessel was opened and the resulting thermally stable diamond bonded compact was removed. Subsequent examination of the compact revealed that the bonded diamond body included a thermally stable upper layer/region of approximately 500 micrometers thick and that was characterized by diamond bonded by SiC. This thermally stable region was well bonded to a PCD lower layer/region of approximately 1,000 micrometers thick that consisted of sintered PCD containing residual Co solvent catalyst.

EXAMPLE 2

Thermally Stable Diamond Bonded Compact—Second Embodiment

Synthetic diamond powders having an average grain size of approximately 2-50 micrometers are mixed together with $Al_2O_3$ for a period of approximately 2-6 hours by ball milling. The volume percent of diamond grains in the mixture is approximately 60-80%. The resulting mixture is cleaned by heating to a temperature in excess of 850° C. under vacuum and is loaded into a refractory metal container. A green-state diamond material is provided in the form of a diamond tape having a thickness of approximately 1.2 mm, comprising diamond grains having an average diamond grain size of approximately 20-30 micrometers, and having a diamond volume percent of approximately 65%. The green-state diamond grain material is loaded into the container adjacent the diamond powder mixture. A WC—Co substrate is positioned adjacent the green-state diamond grain material. The container is surrounded by pressed salt (NaCl) and this arrangement is placed within a graphite heating element. This graphite heating element containing the pressed salt and the diamond powder, green-state diamond grain material, and substrate encapsulated in the refractory container is then loaded in a vessel made of a high-temperature/high-pressure self-sealing powdered ceramic material formed by cold pressing into a suitable shape.

The self-sealing powdered ceramic vessel is placed into a hydraulic press having one or more rams that press anvils into a central cavity. The press is operated to impose an intermediate stage HPHT processing condition of approximately 5500 MPa and approximately 1250° C. on the vessel for a period of approximately 30 minutes. During this intermediate stage processing, the $Al_2O_3$ softens and plastically deforms, filling the void spaces between the diamond grains and undergoes limited solid state reaction with the diamond grains in the mixture to form a diamond region comprising both diamond-to-diamond bonded crystals and diamond crystals bonded together by a reaction product of diamond and the $Al_2O_3$.

The press is subsequently operated at constant pressure to impose an increased temperature of approximately 1450° C. on the vessel for a period of approximately 20 minutes. During this second stage HPHT processing, intercrystalline bonding between the diamond crystals takes place within the green-state diamond grain material to form conventional PCD. Additionally, cobalt from the WC—Co substrate infiltrates into an adjacent region of the green-state diamond grain material, thereby forming a strong bond with the PCD region attaching the substrate thereto.

The press is subsequently operated at constant pressure to impose an increased temperature of approximately 1700° C. on the vessel for a period of approximately 20 minutes. During this final stage HPHT processing, dense sintering of the $Al_2O_3$ ceramic between the diamond crystals in the thermally stable layer takes place and additional interdiffusion between the diamond and $Al_2O_3$ ceramic occurs.

The vessel is opened and the resulting thermally stable diamond bonded compact is removed. Subsequent examination of the compact revealed that the bonded diamond body includes a thermally stable upper layer/region of approximately 500 micrometers thick that is primarily characterized as having a ceramic-bonded diamond microstructure. The diamond body includes another diamond region bonded to the thermally stable region comprising conventional PCD having a layer thickness of approximately 1,000 micrometers thick. Attached to the PCD layers was the substrate having a thickness of approximately 12 mm.

A key feature of thermally stable diamond bonded materials and compacts of this invention is that they are made during a single HPHT process using staged processing techniques. Compacts of this invention comprise a diamond body having both a thermally stable region and a conventional PCD region that are both formed and that is adhered to a metallic substrate during such single HPHT process, thereby reducing manufacturing time and expense. Further, thermally stable diamond bonded materials and compacts of this invention are specifically engineered to facilitate use with a substrate, thereby enabling compacts of this invention to be attached by conventional methods such as brazing or welding to variety of different cutting and wear devices to greatly expand the types of potential use applications for compacts of this invention.

Thermally stable diamond bonded materials and compacts of this invention can be used in a number of different applications, such as tools for mining, cutting, machining and construction applications, where the combined properties of thermal stability, wear and abrasion resistance are highly desired. Thermally stable diamond bonded materials and compacts of this invention are particularly well suited for forming working, wear and/or cutting components in machine tools and drill and mining bits such as roller cone rock bits, percussion or hammer bits, diamond bits, and shear cutters.

FIG. 4 illustrates an embodiment of a thermally stable diamond bonded compact of this invention provided in the form of an insert 34 used in a wear or cutting application in a roller cone drill bit or percussion or hammer drill bit. For example, such inserts can be formed from blanks comprising a substrate portion 36 formed from one or more of the substrate materials disclosed above, and a diamond bonded body 38 having a working surface formed from the thermally stable region of the diamond bonded body. The blanks are pressed or machined to the desired shape of a roller cone rock bit insert.

FIG. 5 illustrates a rotary or roller cone drill bit in the form of a rock bit 42 comprising a number of the wear or cutting inserts 34 disclosed above and illustrated in FIG. 4. The rock bit 42 comprises a body 44 having three legs 46, and a roller cutter cone 48 mounted on a lower end of each leg. The inserts 34 can be fabricated according to the method described above. The inserts 34 are provided in the surfaces of each cutter cone 48 for bearing on a rock formation being drilled.

FIG. 6 illustrates the inserts described above as used with a percussion or hammer bit 50. The hammer bit comprises a hollow steel body 52 having a threaded pin 54 on an end of the body for assembling the bit onto a drill string (not shown) for drilling oil wells and the like. A plurality of the inserts 34 are provided in the surface of a head 56 of the body 52 for bearing on the subterranean formation being drilled.

Figure 7:
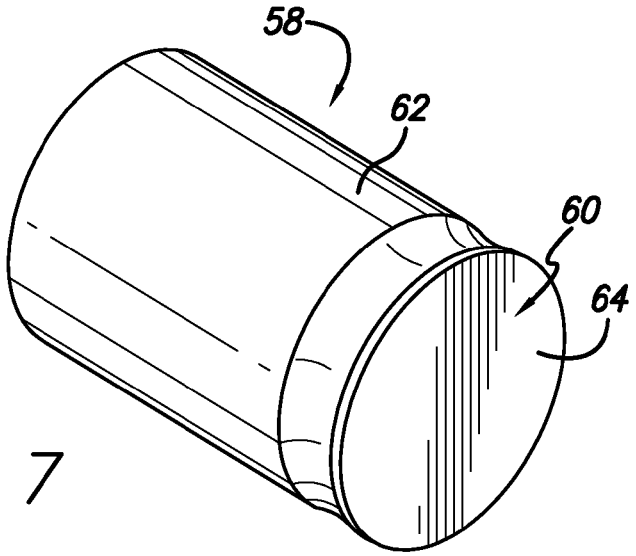
FIG. 7 is a schematic perspective side view of a diamond shear cutter comprising the thermally stable diamond bonded compact of FIGS. 3A and 3B.

FIG. 7 illustrates a thermally stable diamond bonded compact of this invention as embodied in the form of a shear cutter 58 used, for example, with a drag bit for drilling subterranean formations. The shear cutter comprises a diamond bonded body 60 that is sintered or otherwise attached to a cutter substrate 62. The diamond bonded body includes a working or cutting surface 64 that is formed from the thermally stable region of the diamond bonded body.

Figure 8:
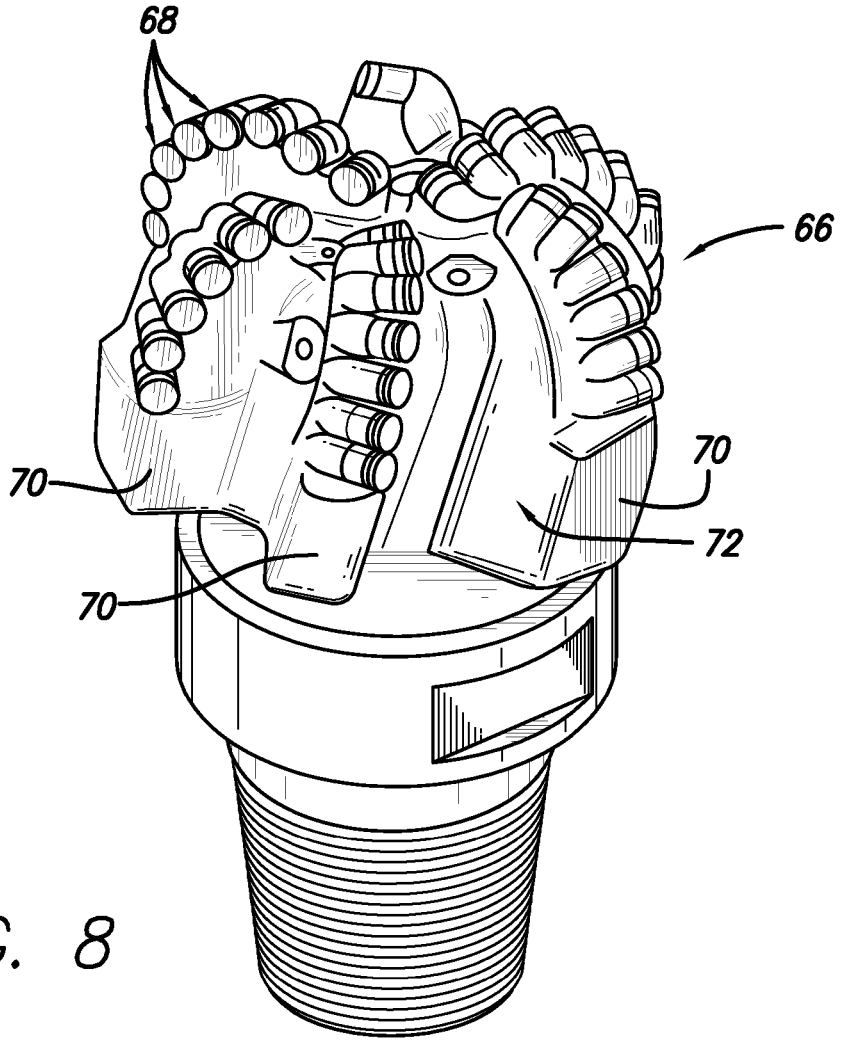
FIG. 8 is a perspective side view of a drag bit comprising a number of the shear cutters of FIG. 7.

FIG. 8 illustrates a drag bit 66 comprising a plurality of the shear cutters 68 described above and illustrated in FIG. 7. The shear cutters are each attached to blades 70 that extend from a head 72 of the drag bit for cutting against the subterranean formation being drilled.

Other modifications and variations of diamond bonded bodies comprising a thermally-stable region and thermally stable diamond bonded compacts formed therefrom will be apparent to those skilled in the art. It is, therefore, to be understood that within the scope of the appended claims, this invention may be practiced otherwise than as specifically described.

What is claimed:

1. A method for forming a thermally stable diamond bonded compact comprising the steps of:

combining together a volume of diamond grains to form a mixture, the mixture being substantially free of a metal solvent catalyst;

positioning a reactant material adjacent the mixture at an eventual working surface or mixing reactant material with the mixture in a region forming the eventual working surface;

placing a metallic substrate adjacent the mixture opposite the eventual working surface to form an assembly, subjecting the assembly to a first temperature and pressure condition to form a sintered thermally stable diamond bonded region being substantially free of metal solvent catalyst and being remote from the metallic substrate, wherein subjecting the assembly to the first temperature and pressure condition comprises heating the assembly to a temperature less than the melting temperature of the metal solvent catalyst;

subjecting the assembly to a second temperature and pressure condition to form a sintered polycrystalline diamond region containing metal solvent catalyst and being adjacent the metallic substrate, and to form an attachment bond between the sintered polycrystalline diamond region and the metallic substrate, thereby forming the thermally stable diamond bonded compact.

2. The method as recited in claim 1, wherein during the step of subjecting the assembly to a first temperature and pressure condition, the reactant material infiltrates into a region of the mixture and reacts with the diamond grains to form a reaction product that bonds together diamond crystals foaming the thermally stable diamond bonded region.

3. The method as recited in claim 1 wherein the thermally stable diamond bonded region has a material microstructure comprising primarily diamond crystals that are bonded together by a reaction product of the diamond grains and a reactant, and wherein the thermally stable diamond bonded region comprises to lesser extent diamond-diamond bonded crystals.

4. The method as recited in claim 1 wherein the volume of diamond used to form the thermally stable diamond bonded region is from about 50 to 400 cubic millimeters, and the amount of the reactant is from about 10 to 80 milligrams.

5. The method as recited in claim 1 wherein the polycrystalline diamond region is formed by infiltrating a solvent metal catalyst into another region of the mixture during the second temperature and pressure condition.

6. The method as recited in claim 1 wherein the first temperature condition is lower than the second temperature condition.

7. The method as recited in claim 1 wherein during the step of combining, a reactant material is mixed together with the diamond grains, and during the step of subjecting the assembly to a first temperature and pressure condition, the reactant material reacts with the diamond grains to form a reaction product that forms the thermally stable diamond bonded region.

8. The methods as recited in claim 7 wherein the thermally stable diamond bonded region comprises primarily diamond crystals bonded together by the reaction product, and to a lesser extent diamond-diamond bonded crystals.

9. The method as recited in claim 1 wherein the assembly further comprises a green-state diamond grain material interposed between the mixture and the metallic substrate, and during the step of subjecting the assembly to a second temperature and pressure condition it is formed into the polycrystalline diamond.

10. The method as recited in claim 1 wherein the metallic substrate includes a metal solvent catalyst and during the step of subjecting the assembly to a second temperature and pressure condition the metal solvent catalyst melts and infiltrates into a region of the adjacent mixture.

11. The method as recited in claim 1 wherein before the step of subjecting the assembly to a first temperature and pressure condition, a reactant material is combined with the mixture that has a melting temperature below the second temperature and pressure condition, and wherein before the step of subjecting the assembly to a second temperature and pressure condition, a solvent metal catalyst material is combined with the mixture that has a melting temperature greater than that of the reactant material.

12. The method as recited in claim 1 wherein the thermally stable diamond bonded region extends from a working surface of the compact to a depth of from about 20 to 500 micrometers.

13. The method of claim 1, wherein the first temperature and pressure condition is different from the second temperature and pressure condition.

14. The method of claim 1, wherein the first temperature and pressure condition is lower than the second temperature and pressure condition.

15. The method of claim 1, wherein the thermally stable diamond bonded region comprises primarily a plurality of diamond grains that are bonded together by a reaction product of the diamond grains and a reactant and, to a lesser extent, diamond-to-diamond bonded grains.

16. The method of claim 1, wherein the polycrystalline diamond region comprises intercrystalline bonded together diamond grains and the metal solvent catalyst disposed within interstitial regions between the intercrystalline bonded together diamond grains.

17. The method of claim 1, wherein subjecting the assembly to the first temperature and pressure condition comprises heating the assembly to a temperature ranging from 1150° C. to 1300° C.

* * * * *